United States Patent [19]

Babuin et al.

[11] Patent Number: 4,833,900

[45] Date of Patent: May 30, 1989

[54] WASHING LIQUID FILTER IN A LAUNDRY WASHING MACHINE

[75] Inventors: Piero Babuin; Roberto Colautti, both of Pordenone, Italy

[73] Assignee: Industrie Zanussi S.p.A., Pordenone, Italy

[21] Appl. No.: 33,107

[22] Filed: Mar. 31, 1987

[30] Foreign Application Priority Data

Apr. 9, 1986 [IT] Italy ..... 45719 A/86

[51] Int. Cl.[4] ..... B06F 17/02; B08B 3/10; B01D 29/24

[52] U.S. Cl. ..... 68/18 F; 68/208; 134/111; 210/497.2

[58] Field of Search ..... 210/488, 489, 490, 497.01, 210/497.2; 68/18 F, 208; 134/111, 108, 109, 110

[56] References Cited

U.S. PATENT DOCUMENTS

| | | | |
|---|---|---|---|
| 1,212,404 | 1/1917 | Robinson | 210/489 |
| 1,284,669 | 11/1918 | Haug | 210/497.01 |
| 1,553,395 | 9/1925 | Ressler | 210/497.01 |
| 1,764,660 | 6/1930 | Sweetland | 210/489 |
| 2,148,826 | 2/1939 | Mallard | 210/489 |
| 2,199,792 | 5/1940 | Haberstump | 68/208 |
| 2,343,743 | 3/1944 | Breckenridge | 68/208 |
| 2,413,954 | 1/1947 | Conferman | 68/208 X |
| 2,764,169 | 9/1956 | Bazarnic | 134/110 |
| 3,727,435 | 4/1973 | Menk . | |
| 4,566,970 | 1/1986 | Piai et al. . | |
| 4,580,421 | 4/1986 | Babuin et al. | 68/18 F X |

FOREIGN PATENT DOCUMENTS

| | | |
|---|---|---|
| 0202509 | 11/1986 | European Pat. Off. . |
| 1191781 | 4/1965 | Fed. Rep. of Germany . |
| 0202509 | 12/1983 | Italy . |

*Primary Examiner*—Harvey C. Hornsby
*Assistant Examiner*—Scott J. Haugland
*Attorney, Agent, or Firm*—Wenderoth, Lind & Ponack

[57] ABSTRACT

A laundry washing machine includes a wash tub, a basket to receive laundry and rotatably mounted within the wash tub, a collection chamber connected to the bottom of the wash tub for collecting washing liquid therefrom, a drain pump for pumping washing liquid in a first direction from the collection chamber to a drain pump during a draining phase of the cycle of operation of the machine, an electrical heating element within the collection chamber for heating washing liquid collected therein, a recirculation pump for pumping heated washing liquid in a second direction from the collection chamber and for recirculating the heated washing liquid to an upper portion of the wash tub during a recirculation phase of the cycle of operation of the machine, and a filter removably mounted within the collection chamber. In particular accordance with the present invention, the filter is in the form of an integral one-piece member including a fine-mesh filtering surface extending transversely across the collection chamber at a position upstream of the heating element with regard to the second direction of washing liquid flow, and a wide-mesh filtering surface positioned upstream of the drain pump with regard to the first direction of washing liquid flow.

6 Claims, 2 Drawing Sheets

WASHING LIQUID FILTER IN A LAUNDRY WASHING MACHINE

BACKGROUND OF THE INVENTION

The present invention relates to a filter employed in laundry washing machines, and more particularly domestic laundry washing machines wherein a laundry load is washed by sprinkling or spraying thereon washing liquid or wash liquor.

As described in European patent application No. 0,202,509, this general type of laundry washing machine essentially includes a wash tub and a laundry receiving basket mounted within the wash tub for rotation therein. A collection chamber or tank is positioned beneath the wash tub and is connected thereto in order to collect wash liquor or washing liquid that is not held back or retained by the laundry within the basket. Such collection tank or chamber is connected both to a discharge or drain duct of the machine via a conventional drain pump and to a sprinkling or spraying assembly located within the top of the wash tub by means of a recirculation duct and a recirculation electric pump. Furthermore, within the collection chamber are located at least one filtering element, an electrical heating element, and a thermostatic sensor for, respectively, filtering, heating and sensing the temperature of the washing liquid.

The filtering element has a fine-meshed surface designed to prevent lint and other impurities transported by the washing liquid from fouling the electric heating element. Thus, such lint and impurities tend to collect on the electrical heating element, thereby lowering its efficiency and reliability over time. This fine-meshed filtering element however has the disadvantage of becoming clogged rapidly and therefore requires that the operator of the machine clean such filter frequently.

To overcome such quick clogging of the filter, it has been proposed, as disclosed in German Patent No. 1,191,781, to provide a laundering filter which is associated with a mechanical device for cleaning the filtering surface of the filter. Such arrangement however is rather complex and expensive.

Additionally, U.S. Pat. No. 3,727,435 discloses a fine-meshed filter for a recirculation-type laundry washing machine which filters the washing liquid which is moved in one direction during recirculation phases toward the washing tub. During the discharge phase, the washing liquid is circulated in an opposite direction, and thereby the material filtered during a previous recirculation phase is carried away from such fine-meshed filter.

Both of these solutions however have the drawback of not providing for removability of the filter and not protecting the drain or discharge pump, particularly if not of the self-cleaning type, from heavy or large size objects (for example buttons, clasps, coins, etc.) which may be carried along by the washing liquid.

It is known in the technology of dish washing machines to provide a fine filtering action in the direction of a recirculation duct and a wide filtering action in a direction toward a drain or discharge duct. Dish washing machines however treat a type of dirt having a form and consistency that are different from that encountered during the washing treatment of laundry. Moreover, between the various elements constituting the filter in a dish washing machine, the fine-meshed component cannot easily be removed and has the function of preventing the obstruction of nozzles of sprinkler arms and not of protecting the surface of electrical heating resistors from foreign objects. Thus, in contradistinction to a dish washing machine, wherein electrical resistor heating elements are located within a tub of the dish washing machine, in a laundry washing machine of the type discussed above, the electrical resistor heating elements are located within the collection chamber and therefore must be protected from foreign objects.

SUMMARY OF THE INVENTION

With the above discussion in mind, it is an object of the present invention to provide a filter for a laundry washing machine of the type described above, which filter is removable, is in the form of a one-piece construction, and prevents lint and other debris from being deposited on the surface of an electrical resistance heating element without requiring cleaning operations that are more frequent than those carried out by the user of the machine than is the case with laundry washing machines with traditional wash tubs.

It is a further object of the present invention to provide a laundry washing machine incorporating such improved filter.

The above objects are achieved in accordance with the present invention by the provision of a filter for use in a laundry washing machine of the type including a wash tub, a basket to receive laundry and rotatably mounted within the wash tub, a collection chamber connected to the bottom of the wash tub for collecting washing liquid therefrom, a drain pump for pumping washing liquid in a first direction from the collection chamber to a drain pump during a draining phase of the cycle of operation of the machine, an electrical resistor heating element within the collection chamber for heating washing liquid collected therein, and a recirculation pump for pumping heated washing liquid in a second direction from the collection chamber and for recirculating the heated washing liquid to an upper portion of the wash tub during a recirculation phase of the cycle of operation of the machine. Specifically, in accordance with the present invention, the filter is removably mounted within the collection chamber and comprises an integral one-piece member including a fine-mesh filtering surface extending transversely across the collection chamber at a position upstream of the heating element with regard to the second direction of washing liquid flow, and a wide-mesh filtering surface positioned upstream of the drain pump with respect to the first direction of washing liquid flow.

In accordance with one embodiment of the present invention, the integral one-piece filter member includes a substantially cylindrical element having a lower end positioned substantially in contact with a bottom wall of the collection chamber, the cylindrical filter element including a first portion of fine-mesh filter structure defining the fine-mesh surface and directed toward the heating element, and a second portion of wide-mesh filter structure defining the wide-mesh filtering surface and directed toward the drain pump.

In accordance with another embodiment of the present invention, the integral one-piece filter member includes a cylindrical wide-mesh filter body defining the wide-mesh filtering surface and having a lower end terminating substantially at an upper wall of the collection chamber, and a fine-mesh partition extending from the lower end of the cylindrical wide-mesh filter body and having a lower end positioned substantially in contact with a bottom wall of the collection chamber.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
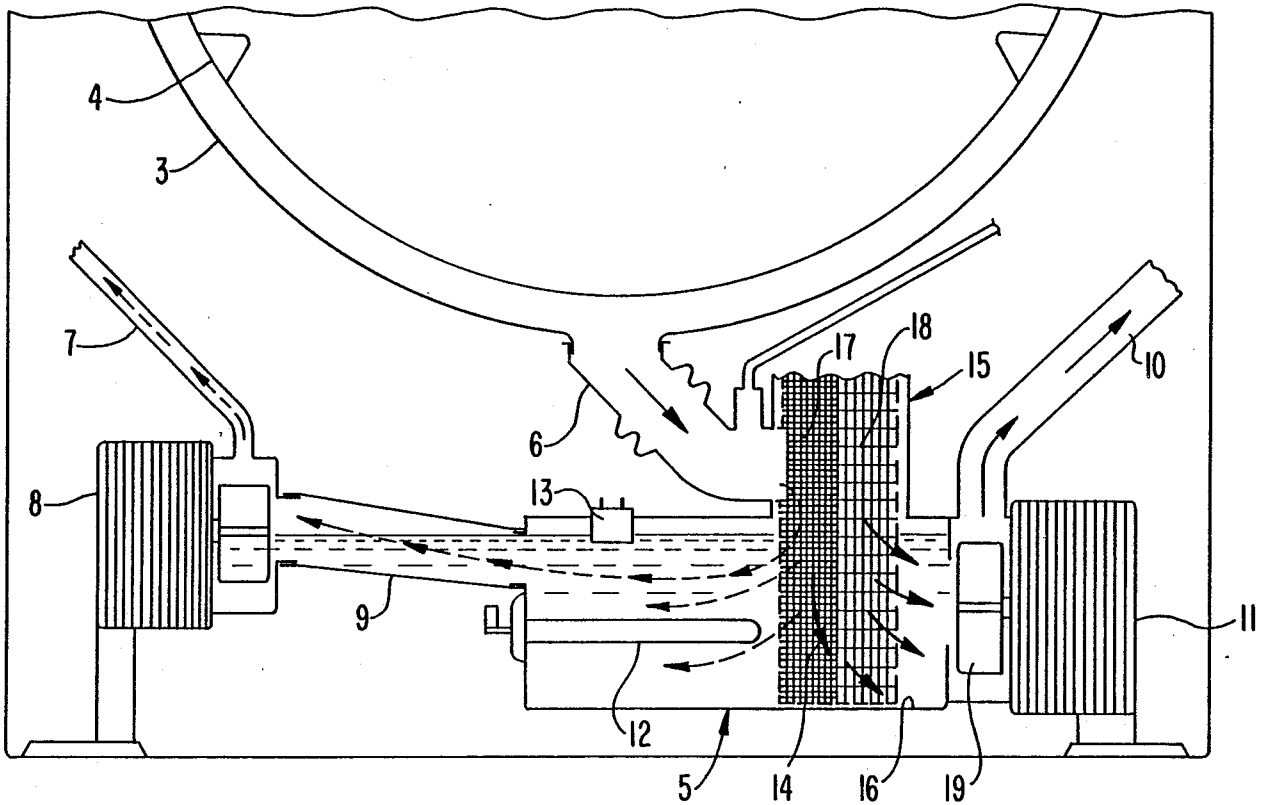
FIG. 1 is a schematic view of a filter according to a first embodiment of the present invention.

FIG. 1 illustrates a first embodiment of the present invention and schematically illustrates the lower portion of a laundry washing machine of generally known type and including a wash tub 3 having mounted for rotation therein a laundry receiving basket. It is contemplated that this laundry washing machine be of the jet-type and as disclosed in European patent application No. 0,202,509. Beneath the wash tub 3 is positioned a collection tank or chamber 5 for collecting washing liquor or washing liquid that is not held back and retained by the laundry load in basket 4. Collection chamber 5 is connected to the bottom of wash tub 3 by means of a flexible conduit or duct 6. Furthermore, wash liquid collected in collection chamber 5 is recirculated to the top of the wash tank (in a known manner) during recirculation phases of the cycle of operation of the machine by means of a duct 9 leading from an upper portion of collection chamber 5, a recirculation pump 8, and a conduit or duct 7. Thus, washing liquid is pumped by pump 8 through conduits 9, 7 to the top of wash tub 3 in order to spray or jet the washing liquid onto laundry within basket 4.

Collection chamber 5 also is connected to a drain or discharge duct 10 by means of a drain pump 11 of the traditional non-self-cleaning type. Thus, during a drain or discharge phase of the cycle of operation of the machine, pump 11 operates to pump collected washing liquid to a drain.

Collection chamber 5 is dimensioned to receive therein an electrical resistance heating element 12 and a thermostatic sensor 13 to control operation of heating element 12. Thus, the washing liquid pumped by pump 8 back to the top of wash tub 3 is heated by electrical resistance heating element 12, the operation of which is controlled by thermostat 13.

Collection tank or chamber 5 includes a filtering element to prevent lint and other debris from collecting around heating element 12 and thus deleteriously effecting the operation thereof. In accordance with the present invention, the filter is in the form of a filtering element 14 which is removably mounted within a housing 15 which is integral with or forms part of the collection tank 5, in a manner such that the filter can be removed externally of the laundry washing machine, i.e. upwardly from collection chamber 5. It is contemplated that the filtering element 14 and the housing 15 may be curved and extend downwardly, for example as disclosed in U.S. Pat. No. 4,566,970.

More particularly, in the embodiment shown in FIG. 1, the filtering element 14 is substantially cylindrical with an opening therethrough at least in the area where duct 6 extends into housing 15, such that washing liquid passes into the interior of the cylindrical filtering element 14. The upper end of filtering element 14, not shown, may be connected to a closure member covering the housing 15. The lower end of cylindrical filtering element 14 extends downwardly to a position substantially in contact with a bottom wall 16 of collection chamber 5.

Filtering element 14 includes a fine-mesh filtering surface extending transversely across collection chamber 5 at a position upstream of heating element 12, with respect to the direction of washing liquid flow during recirculation thereof, as indicated by the dashed arrows in FIG. 1. Filtering element 14 further has a wide-mesh filtering surface positioned upstream of drain pump 11 in the direction of washing liquid flow during discharge thereof, as shown by the solid arrows in FIG. 1. More particularly, the cylindrical filter element 14 includes a first portion 17 of fine-mesh filter structure defining the fine-mesh surface and directed toward the heating element. The cylindrical heating element 14 further specifically includes a second portion 18 of wide-mesh filter structure defining the wide-mesh filtering surface and directed toward drain pump 11. As shown in FIG. 1, portions 17 and 18 are spaced from each other.

During a washing phase of the cycle of operation of the laundry washing machine, i.e. during recirculation of the washing liquid, the washing liquid passes from the interior of cylindrical filter element 14 and passes through the fine-meshed structure 17 before passage thereof through conduits 9, 7 by means of pump 8. As a result, all foreign objects present in the washing liquid, including any lint and debris, are held back by the fine-mesh filtering structure 17.

When the washing machine then is transferred to a discharge phase of the cycle of operation, the washing liquid is pumped by drain pump 11 and passes through the wide-meshed filter structure 18 before being discharged by duct 10 to a drain. During this phase, the washing liquid moves along the surface of fine-mesh filtering structure 17 to remove therefrom and carry along any lint or debris deposited thereon during a previous recirculation phase. Such lint or debris passes through wide-mesh filter structure 18 and is discharged. However, wide-mesh filter structure 18 will retain any large items from the washing liquid, for example buttons, coins, etc., thereby preventing damage to pump 11.

Figure 2:
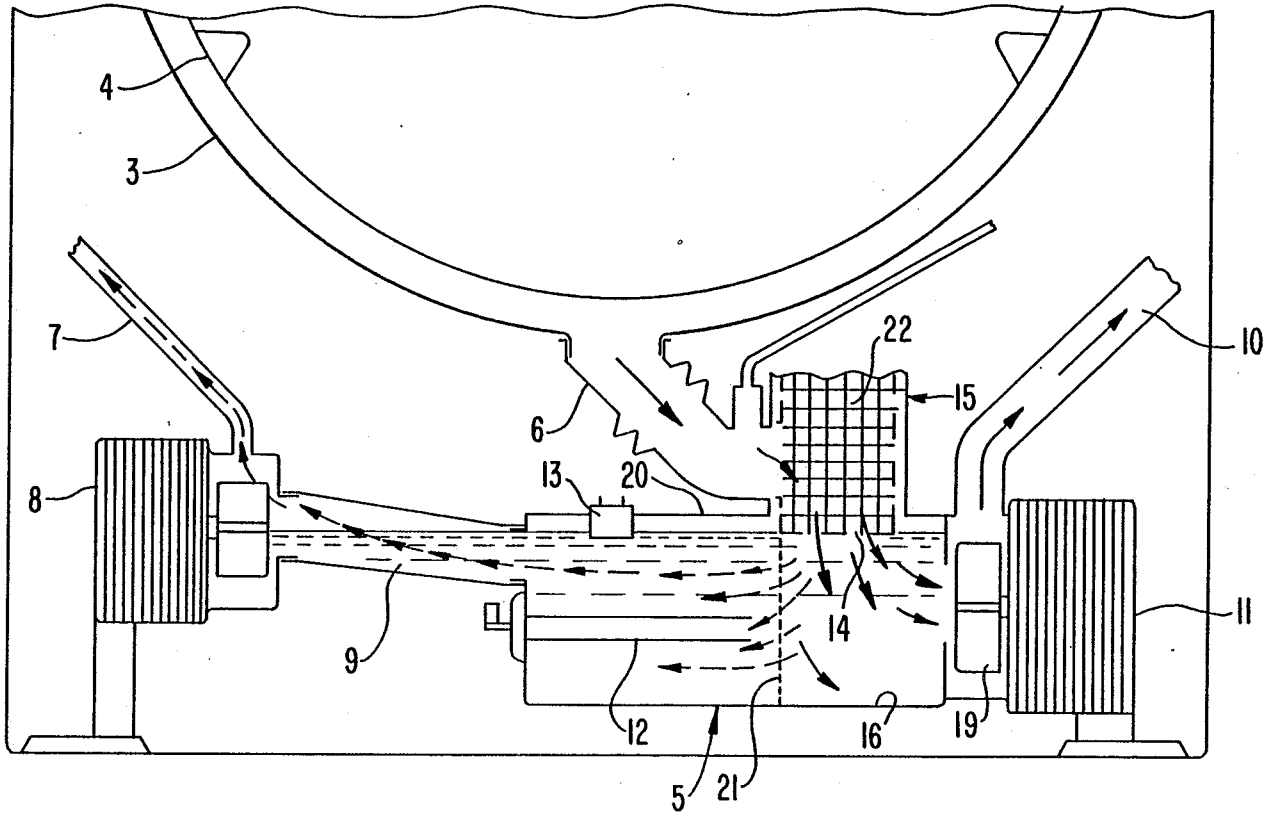
FIG. 2 is a similar view but of a second embodiment of the filter of the present invention.

Reference now will be made to FIG. 2 which illustrates a second embodiment of the present invention. The laundry washing machine of this embodiment is the same as described above regarding the embodiment of FIG. 1, with the exception of the structure of filter element 14. In this embodiment, filter element 14 includes a cylindrical wide-mesh filter body 22 defining the wide-mesh filter surface and having a lower end terminating substantially at an upper wall 20 of collection chamber 5. The entire structure of filter body 22 is wide-mesh. A fine-mesh partition 21 extends from the lower end of cylindrical wide-mesh filter body 22 and has a lower end positioned substantially in contact with bottom wall 16 of collection chamber 5. The fine-mesh partition 21 defines the fine-mesh surface of the filter element. As shown in FIG. 2, body 22 and partition 21 are spaced from each other. The filter body 22 may have an opening aligned with duct 6, with the bottom of body 22 having a wide-mesh structure. Alternatively, it would be possible to provide the wide-mesh filter structure across the communication with duct 6 and then to have the bottom of filter body 22 open.

During the washing phase of the cycle of operation of the laundry washing machine, the washing liquid from tub 3 and duct 6 passes through the wide-meshed structure 22 and then through the fine-mesh partition 21, as indicated by the dashed arrows in FIG. 2. When the machine thereafter is operated in the discharge phase of the cycle of operation thereof, the washing liquid again passes through the wide-mesh filter structure 22 and moves along the surface of partition 22, thereby removing lint and other debris deposited thereon in a previous recirculation phase, and such removed lint and debris then is discharged by pump 11 along with the washing liquid. However, any large items within the washing liquid are retained by the wide-mesh filter structure 22.

It is contemplated in accordance with both of the above embodiments of the present invention that the fine-mesh filter structure 17 and fine-mesh partition 21 having a mesh size such that lint and other debris does not partially pass therethrough and become entangled or entrapped on such fine-mesh filter. Rather, it is contemplated that the mesh size of the fine-mesh filter member be small enough simply to entrap lint and other debris on the upstream surface thereof in a manner such that the thus trapped lint and debris thereafter easily may be removed from such surface during the drain phase of the cycle of operation. On the other hand, the wide-meshed filter structures 18, 22 are intended to allow the passage therethrough of such collected lint and other debris, but to hold back any coarser or larger sized items that might damage or obstruct impeller 19 of pump 11. It is believed that one skilled in the art would understand from the present discussion how to determine and make the various filter members of the mesh sizes to achieve these disclosed functions.

Furthermore, the removability and ease of handling of the single-piece filter of the present invention facilitates periodic cleaning operations of its filtering surfaces and the dislodging of any collected objects that may be entrapped thereby. With the above operations in mind, a primary feature of the present invention is the prevention of lint being deposited on the surface of the electrical resistance heating element without requiring the operator of the machine to conduct frequent filter cleaning operations.

Although the present invention has been described and illustrated with respect to preferred features thereof, it is to be understood that various modifications and changes may be made to the specifically described and illustrated features without departing from the scope of the present invention.

We claim:

1. In a laundry washing machine including a wash tub, a basket to receive laundry and rotatably mounted within said wash tub, a collection chamber separate from and connected to the bottom of said wash tub for collecting washing liquid therefrom, a drain pump for pumping washing liquid in a first direction from said collection chamber to a drain duct during a draining phase of the cycle of operation of said machine, an electrical heating element within said collection chamber for heating washing liquid collected therein, a recirculation pump for pumping heated washing liquid in a second direction from said collection chamber and for recirculating the heated washing liquid to an upper portion of said wash tub during a recirculation phase of the cycle of operation of said machine, and filter means removably mounted within said collection chamber for preventing lint from collecting on said heating element, the improvement wherein said filter means comprises an integral one-piece member mounted within said collection chamber for removal therefrom in an upward direction, said one-piece member including:

a fine-mesh filtering surface extending transversely across said collection chamber at a position upstream of said heating element in said second direction; and a wide-mesh filtering surface spaced from said fine-mesh filtering surface and positioned upstream of said drain in said first direction.

2. The improvement claimed in claim 1, wherein said integral one-piece filter member comprises a substantially cylindrical element having a lower end positioned substantially in contact with a bottom wall of said collection chamber, said cylindrical filter element including a first portion of fine-mesh filter structure defining said fine-mesh surface and directed toward said heating element and a second portion of wide-mesh filter structure defining said wide-mesh filtering surface and directed toward said drain pump.

3. The improvement claimed in claim 1, wherein said integral one-piece filter member comprises a cylindrical wide-mesh filter body defining said wide-mesh filtering surface and having a lower end terminating substantially at an upper wall of said collection chamber, and a fine-mesh partition extending from said lower end of said cylindrical wide-mesh filter body and having a lower end positioned substantially in contact with a bottom wall of said collection chamber.

4. A filter to be mounted in a collection chamber of a laundry washing machine for removal therefrom in an upward direction for filtering washing liquid pumped from the collection chamber either in a draining first direction or in a recirculating second direction and for preventing collection of lint on a heating element within the collection chamber, said filter comprising an integral one-piece member including:

a fine-mesh filtering surface to be positioned to extend across the collection chamber and to face in said second direction; and a wide-mesh filtering surface spaced from said fine-mesh filtering surface and to be positioned to filter washing liquid pumped in said first direction.

5. A filter as claimed in claim 4, wherein said integral one-piece filter member comprises a substantially cylindrical element having a lower end to be positioned substantially in contact with a bottom wall of the collection chamber, said cylindrical filter element including a first portion of fine-mesh filter structure defining said fine-mesh surface and a second portion of wide-mesh filter structure defining said wide-mesh filtering surface.

6. A filter as claimed in claim 4, wherein said integral one-piece filter member comprises a cylindrical wide-mesh filtering surface and having a lower end to be positioned substantially at an upper wall of the collection chamber, and a fine-mesh partition extending from said lower end of said cylindrical wide-mesh filter body and having a lower end to be positioned substantially in contact with a bottom wall of the collection chamber.

* * * * *